US007413172B2

(12) United States Patent
Kanzler et al.

(10) Patent No.: US 7,413,172 B2
(45) Date of Patent: Aug. 19, 2008

(54) WINCH FOR A VEHICLE AND METHOD FOR COUPLING AND/OR UNCOUPLING AND ANCHORING DEVICE TO AND/OR FROM A POSITIONALLY FIXED ANCHOR PART

(75) Inventors: Helmut Kanzler, Voehringen (DE); Bernd Junginger, Blaustein (DE)

(73) Assignee: Kaessbohrer Gelaendefahrzeug AG, Laupheim (DE)

( * ) Notice: Subject to any disclaimer, the term of this patent is extended or adjusted under 35 U.S.C. 154(b) by 0 days.

(21) Appl. No.: 11/715,790

(22) Filed: Mar. 8, 2007

(65) Prior Publication Data

US 2007/0234528 A1 Oct. 11, 2007

(30) Foreign Application Priority Data

Mar. 9, 2006 (DE) ..... 10 2006 011 906

(51) Int. Cl.
*B66D 1/00* (2006.01)

(52) U.S. Cl. ..... 254/323; 254/326; 254/334; 294/82.2

(58) Field of Classification Search ..... 254/323, 254/326, 334; 294/82.19, 82.2
See application file for complete search history.

(56) References Cited

U.S. PATENT DOCUMENTS 1,873,917 A * 8/1932 Ashley ..... 258/1.8
4,277,053 A * 7/1981 Simon ..... 254/326
4,751,892 A * 6/1988 Sechel et al. ..... 114/221 R
5,340,181 A * 8/1994 Matsuyama ..... 294/82.33
5,474,278 A * 12/1995 Cleveland ..... 254/334
6,386,514 B1 * 5/2002 Ray ..... 254/323

FOREIGN PATENT DOCUMENTS

DE 20 2004 008 718 U1 11/2005
DE 10 2004 025 973 A1 12/2005

* cited by examiner

*Primary Examiner*—Emmanuel M Marcelo
(74) *Attorney, Agent, or Firm*—Flynn, Thiel, Boutell & Tanis, P.C.

(57) ABSTRACT

Winch for a vehicle and method for coupling and/or uncoupling an anchoring device to and/or from a positionally fixed anchor part The invention relates to a winch for a vehicle, in particular for a piste maintenance vehicle, with an elongate flexible traction means which is assigned to a drive device which is configured for the introduction of tractive forces to the traction means, and with a guide device which is provided for feeding the traction means to the drive device, and also with an anchoring device which is mounted on a free end region, facing away from the drive device, of the traction means and is configured so as to be adjustable between an opening position and a locking position, in order to allow a positive anchoring of the traction means on a positionally fixed anchor part, and also to a method for coupling and/or uncoupling an anchoring device to and/or from the fixed anchor part.

Figure 1:
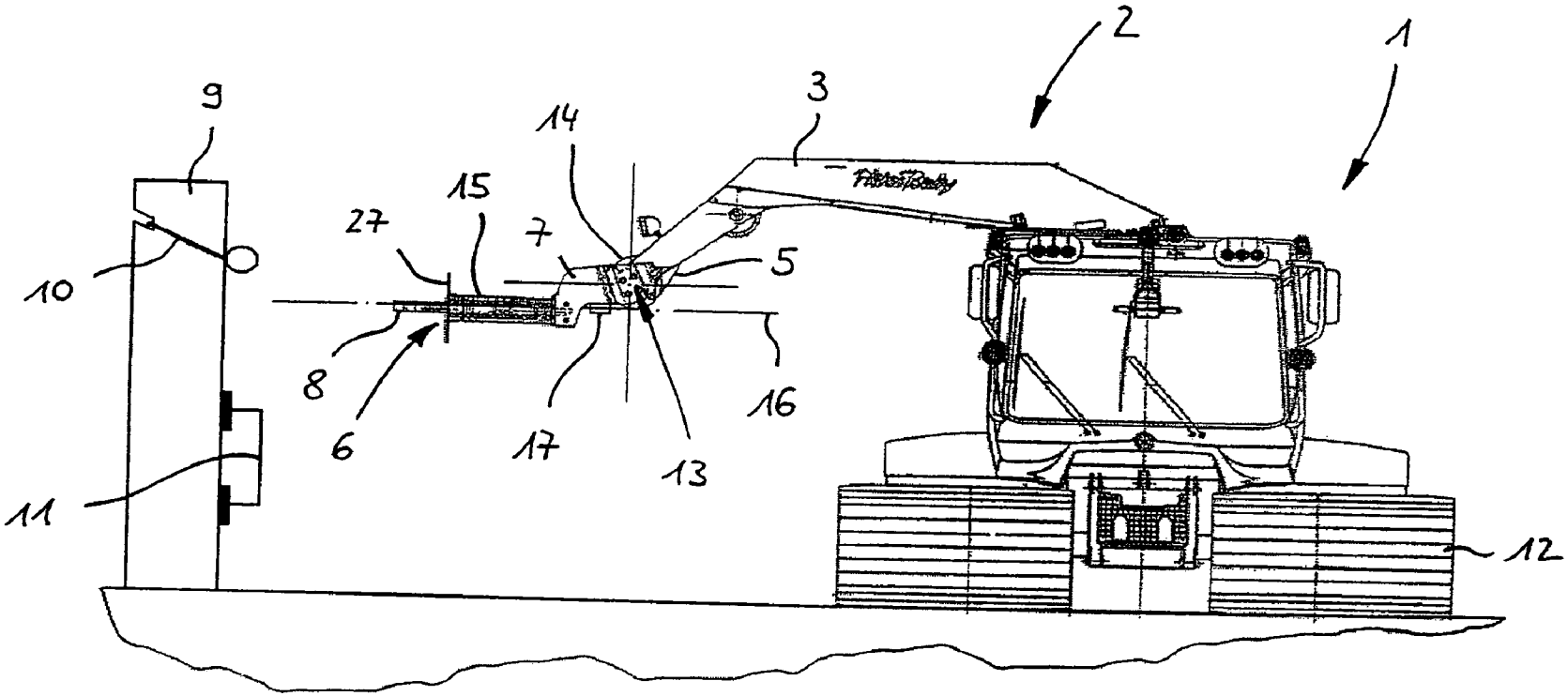

According to the invention, the anchoring device and/or the guide device is assigned an actuating means which is configured for an opening and/or closing movement of the anchoring device.

8 Claims, 4 Drawing Sheets

WINCH FOR A VEHICLE AND METHOD FOR COUPLING AND/OR UNCOUPLING AND ANCHORING DEVICE TO AND/OR FROM A POSITIONALLY FIXED ANCHOR PART

The invention relates to a winch for a vehicle, in particular for a piste maintenance vehicle, with an elongate flexible traction means which is assigned to a drive device which is configured for the introduction of tractive forces to the traction means, and with a guide device which is provided for feeding the traction means to the drive device, and also with an anchoring device which is mounted on a free end region, facing away from the drive device, of the traction means and is configured so as to be adjustable between an opening position and a locking position, in order to allow a positive anchoring of the traction means on a positionally fixed anchor part, and also to a method for coupling and/or uncoupling an anchoring device to and/or from the fixed anchor part.

A winch of this type is known from the applicant's product range and is used preferably for piste maintenance vehicles which are sold by the applicant under the tradename "Piste Bully", for the maintenance and preparation of steep ski runs. The known winch is mounted so as to be rotatable about a vertical axis on a chassis of the piste maintenance vehicle and the traction means has a drive device which typically comprises a winder designed as a rope drum and a hydraulic motor for introducing a tractive force to the traction means, with it being possible for the traction means to be wound onto the rope drum and unwound from the rope drum. In the known winch, the flexible traction means used is a steel rope preferably designed as a round-strand rope, with a locking device designed as a hook, in the manner of a crane hook which can be closed by means of a snap fastening, being attached to a free end region, facing away from the winder, of the steel rope. The winch is provided with a guide device which is typically configured as a jib with rope guide devices and which is provided for feeding the traction means to the drive device. The guide device makes it possible to guide the traction means from the winder over and above a driver's cab of the piste maintenance vehicle, so that a driver of the piste maintenance vehicle has the traction means in his field of vision at least in the main application when the piste maintenance vehicle is oriented upward on a slope. Moreover, the guide device can assume the task of orienting the traction means in the manner of positive guidance into a predefinable direction with respect to the piste maintenance vehicle, in order to cause the tractive forces which can be transmitted by the traction means to engage on the piste maintenance vehicle in an advantageous way.

The hook can be hooked up to an anchor part which is mounted at a fixed location above a ski run and is provided with a rope loop or with a holding shackle and which is typically designed as a pole anchored in the ground. The snap fastening of the hook, which is preferably held in a closed locking position by a return spring, can be brought into an opening position by the user by manually applying an actuating force, in order to make it possible for the hook to be hooked onto or unhooked from the anchor part. The hook is hooked up and unhooked manually by an operator of the piste maintenance vehicle, that is to say, to couple or uncouple the hook attached to the traction means, the operator has to leave the driver's cab of the piste maintenance vehicle and walk as far as the anchor part in order to carry out the coupling operation on the spot. On account of the risks arising from the tensioned traction means, piste preparation assisted by the winch preferably takes place in the evening or during the night after skiing on the ski runs has ceased. As a result of these constraints, it is troublesome for the user to have to hook up and unhook the hook to and from the anchor part in darkness and when it is cold and, possibly, in poor weather conditions.

The object of the invention is to provide a winch which allows a remote-controlled hooking-up and/or unhooking operation for the anchoring device.

According to the first aspect of the invention, said object is achieved by means of a winch of the type specified in the introduction, in which the anchoring device and/or the guide device are/is assigned an actuating means which is configured for an opening and/or closing movement of the anchoring device. The actuating means allows the locking device to be coupled to or uncoupled from the positionally fixed anchor part, without the winch user having to influence the anchoring device manually. Instead, it is possible for the winch user to carry out the coupling and/or uncoupling operation on the anchor part remotely, so that, when the winch is used on a piste maintenance vehicle, it is possible to avoid leaving the driver's cab. This affords a simplification of the coupling and/or uncoupling operation, thus leading to an increase in safety and convenience when the winch is used, since potential risks which may arise upon leaving the piste maintenance vehicle in darkness and when the anchoring device is actuated manually are eliminated. The actuating means may be designed for an active or a passive opening and/or closing movement. In the case of an active opening and/or closing movement, the actuating means introduces a movement, which may be brought about in particular by hydraulic, electrical or pneumatic energy, directly into the locking device. In the case of a passive opening and/or closing movement, the actuating means is activated by means of a relative movement with respect to the locking device and/or with respect to the guide device.

In a refinement of the invention, it is provided that the actuating means is configured in such a way that, when a minimum distance between the anchoring device and guide device is undershot, a positive movement of the anchoring device into the opening position is provided. An advantageous activation of the actuating means can consequently be brought about, whereby a positive opening movement of the anchoring device takes place solely as a result of the anchoring device approaching the guide device. This makes its possible to couple and uncouple the anchoring device to and from the anchor part safely and in an easily controllable way. The positive movement of the actuating means may preferably be brought about by a positively locking coupling between the actuating means of the guide device and/or the anchoring device.

In a further refinement of the invention, it is provided that the actuating means is configured in such a way that, when a minimum distance between the anchoring device and the guide device is exceeded, a positive movement of the anchoring device into the locking position is provided. When the minimum distance which can be predefined structurally by the configuration of the actuating means, of the anchoring device and of the guide device is exceeded, a positive closing movement of the anchoring device into the locking position takes place. The closing movement takes place when the anchoring device is hooked up to the anchor part and the winch is removed from the anchoring device as a result of the traction means being unwound from the drive device, as is typical of the use of the winch. The positive movement of the anchoring device into the locking position may be carried out by means of an energy accumulator, in particular a return spring, assigned to the actuating means or to the anchoring device. The energy accumulator is charged with energy in particular during an opening movement of the anchoring device and can, in the event of a reduction in an external force acting from outside, discharge the stored energy again to the anchoring device, thus leading to the desired locking movement. Positive guidance of the actuating means may also be envisaged, so that a locking movement is brought about solely, or if appropriate with the assistance of an energy accumulator, as a result of the increase in a distance between the anchoring device and the guide device. Positive guidance of said type may be implemented preferably by means of a slotted guide which is provided on the guide device or on the anchoring device and which, in the event of a relative movement between the guide device and anchoring device, leads to a positive movement of the actuating means.

In a further refinement of the invention, it is provided that the guide device is coordinated, in an aperture region for the traction means, with an outer contour of the anchoring device, so that, when a minimum distance between the anchoring device and the guide device is undershot, a positive actuation of the actuating means is ensured. In the aperture region, the traction means which can be wound on the winder and is guided by the guide device emerges freely into the surroundings. The aperture region is configured in such a way that, when the minimum distance is undershot, the anchoring device and the assigned actuating means assume a predefinable and reproducible position relative to the guide device in which the desired positive actuation of the actuating means can take place. In a preferred embodiment of the invention, it is provided that the guide device is coordinated, in an aperture region for the traction means, with an outer contour of the anchoring device, so that, when the minimum distance is undershot, a positive guidance for the anchoring device is ensured. This is brought about preferably by a positively locking reception of the anchoring device on the guide device. A coupling and/or uncoupling operation of the anchoring device can consequently be brought about by linear and/or rotational movements of the guide device, without a relative movement of the anchoring device with respect to the guide device occurring in the process, which would impede hooking up to or unhooking from the anchor part.

In a further refinement of the invention, it is provided that the anchoring device is of hook-shaped design and is provided with a pivoting lever for closing the hook, with the actuating means being configured for an activation of the pivoting lever. It is possible by means of a hook to provide a compact and highly load-bearing anchoring device, in which a closure for reliable locking on the anchor part can be brought about by means of a pivoting lever which is preferably spring-preloaded into the locking position. The pivoting lever can be transferred by the actuating means, counter to a return force of the energy accumulator designed as a return spring, out of the locking position and into the opening position in order to allow coupling to or uncoupling from the anchor part.

In a further refinement of the invention, it is provided that the actuating means is attached, in particular in one piece, to the pivoting lever. A simple design for the actuating means can consequently be implemented, and the actuating means is preferably produced in one piece, that is to say integrally, with the pivoting lever or is connected to the pivoting lever in a materially integral way.

In a further refinement of the invention, it is provided that the pivoting lever, and the actuating means are mounted in the manner of a rocker on the anchoring device. In the case of a rocker-like configuration of the pivoting lever and of the actuating means, two limbs are provided which project essentially in opposite directions from a joint region and are designed as a pivoting lever and as an actuating means. A pivotable connection to the anchoring device is provided in the joint region. The jointed connection is designed in such a way that the pivoting lever can close the anchoring device, which is designed as a hook, so as to form a closed eye ring, so that a rope loop or a holding shackle on the anchor part can be reliably grasped in order to ensure that tractive forces are transmitted from the traction means to the anchor part.

In a further refinement of the invention, it is provided that the guide device has a deflection surface for the actuating means in an aperture region for the traction means, said deflection surface being provided for a positive control of the actuating means when a minimum distance between the anchoring device and guide device is undershot. The deflection surface on the guide device provides, for a correspondingly configured actuating means, a positive guide means which leads to a pivoting movement of the pivoting lever into the opening position. The deflection surface is preferably oriented essentially orthogonally with respect to a direction of emergence of the traction means in the aperture region, so that, as the anchoring device approaches, an actuating force acting essentially in the direction of emergence can take effect on the actuating means.

In a further refinement of the invention, it is provided that the actuating means is configured, at least in sections, in the shape of a sickle for a sliding movement on the deflection surface of the guide device and for feeding the traction means into the anchoring device. A configuration of the actuating means which is sickle-shaped in sections achieves two advantageous effects. The sickle shape of the actuating means allows a sliding movement between the actuating means and deflection surface, which sliding movement is accompanied by an opening movement of the pivoting lever of the anchoring device. The sickle shape of the actuating means affords a jaw-like geometry which allows a particularly advantageous reception of the rope loop or of the holding shackle provided on the anchor part without having to ensure highly accurate positioning of the winch for coupling the anchoring device to the anchor part.

In a further refinement of the invention, it is provided that the anchoring device is mounted so as to be freely movable on a traction means lug provided on the end side on the free end of the traction means. The traction means lug is preferably formed by an end-side rope loop, in which an end region of the traction means is folded round semicircularly, and the traction means end is fastened by means of rope clamps to a traction means section in front of the rope loop. The anchoring device has a fastening lug, through which the rope loop is guided, so that the anchoring device can be freely set to different load directions of the traction means, without a considerable bending moment, which is harmful to the traction means, being introduced to the rope loop.

In a further refinement of the invention, it is provided that the guide device is assigned sensor means which are configured for detecting and indicating the opening position and/or the locking position of the anchoring device. With the aid of the sensor means which are assigned to the anchoring device, it is possible, remotely from the anchoring device, to provide an indication of whether the anchoring device is in the opening position or in the locking position. For this purpose, at least one sensor means may be provided in the anchoring device or on the guide device, which sensor device determines a correct opening and/or a correct closing of the anchoring device and illustrates this in a form perceptible to the user, for example visually or acoustically. Consequently, for example when coupling the anchoring device to the anchor part, it is possible to determine, even from some distance, particularly from the driver's cab of the piste maintenance vehicle, whether correct locking of the anchoring device has taken place. Additionally or alternatively, the sensor means may also determine, for the uncoupling operation, whether the anchoring device is in the opening position, so that the uncoupling operation can be carried out, for example by pivoting the winch about a vertical axis.

According to a further aspect of the invention, a method for coupling a traction means to a positionally fixed anchor part is provided with the following method steps:

carrying out an opening movement of a closable anchoring device, which is attached to the end side of the traction means, by moving the anchoring device closer to a guide device for the traction means, p1 advancing and hooking up the open anchoring device to the anchor part, in particular by means of a pivoting movement of the guide device, closing the anchoring device by enlarging a distance between the guide device and the anchoring device.

It is possible by means of a method of said type to provide remotely operable, at least partially automated coupling of the anchoring device to an anchor part. The opening movement of the anchoring device takes place positively solely as a result of the anchoring device approaching the guide device.

According to a further aspect of the invention, a method for uncoupling a traction means from a positionally fixed anchor part is provided with the following steps:

carrying out an opening movement of a closable anchoring device, which is attached to the end side of the traction means, by moving the anchoring device closer to a guide device for the traction means, unhooking the anchoring device from the anchor part, in particular by means of a pivoting movement of the guide device.

This allows a remotely-operable decoupling of the anchoring device from the anchor part.

Figure 2:
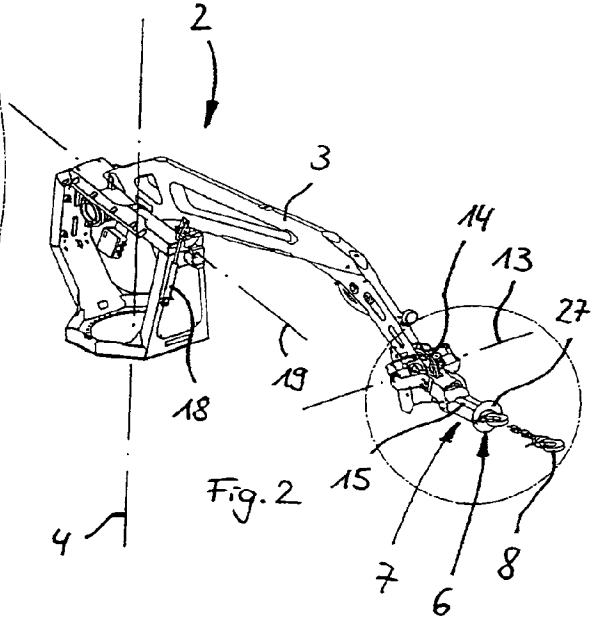
Figure 3:
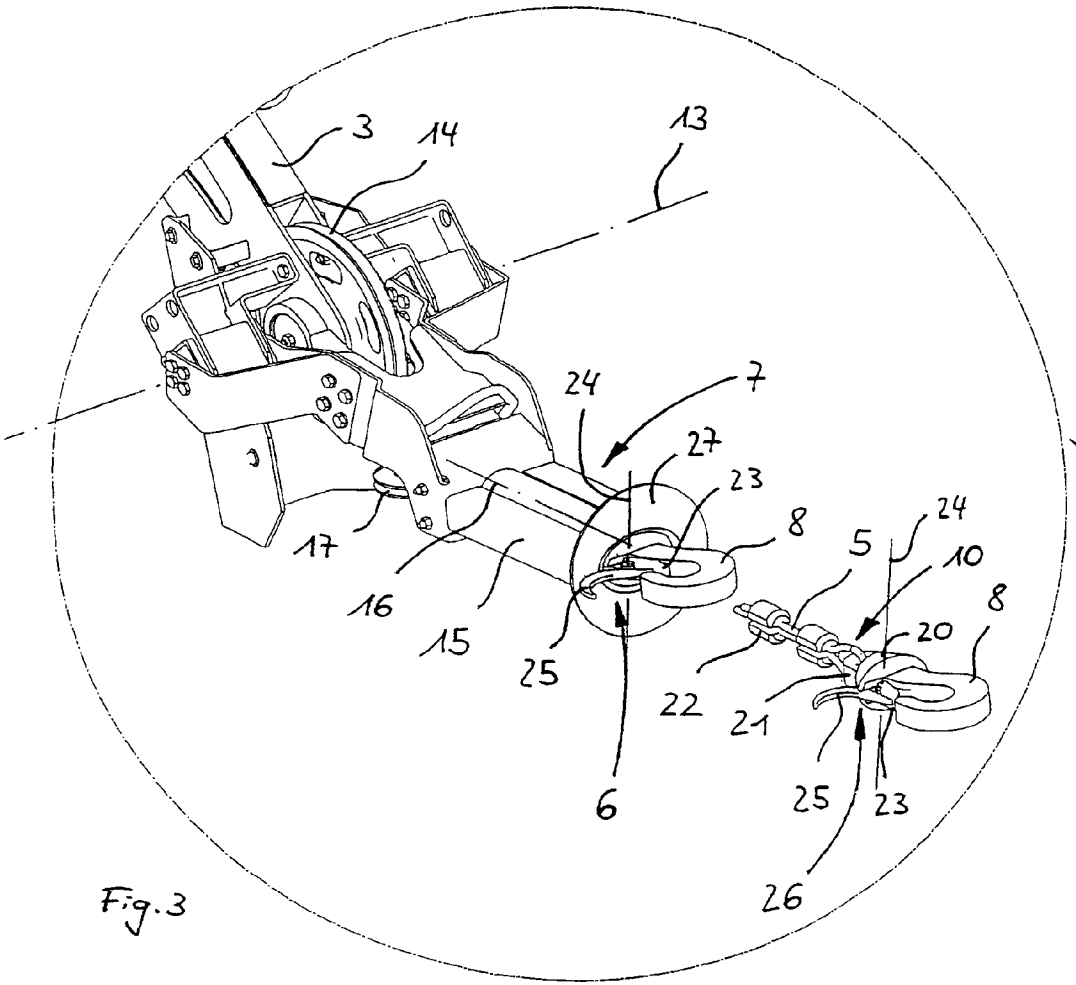
Figure 4:
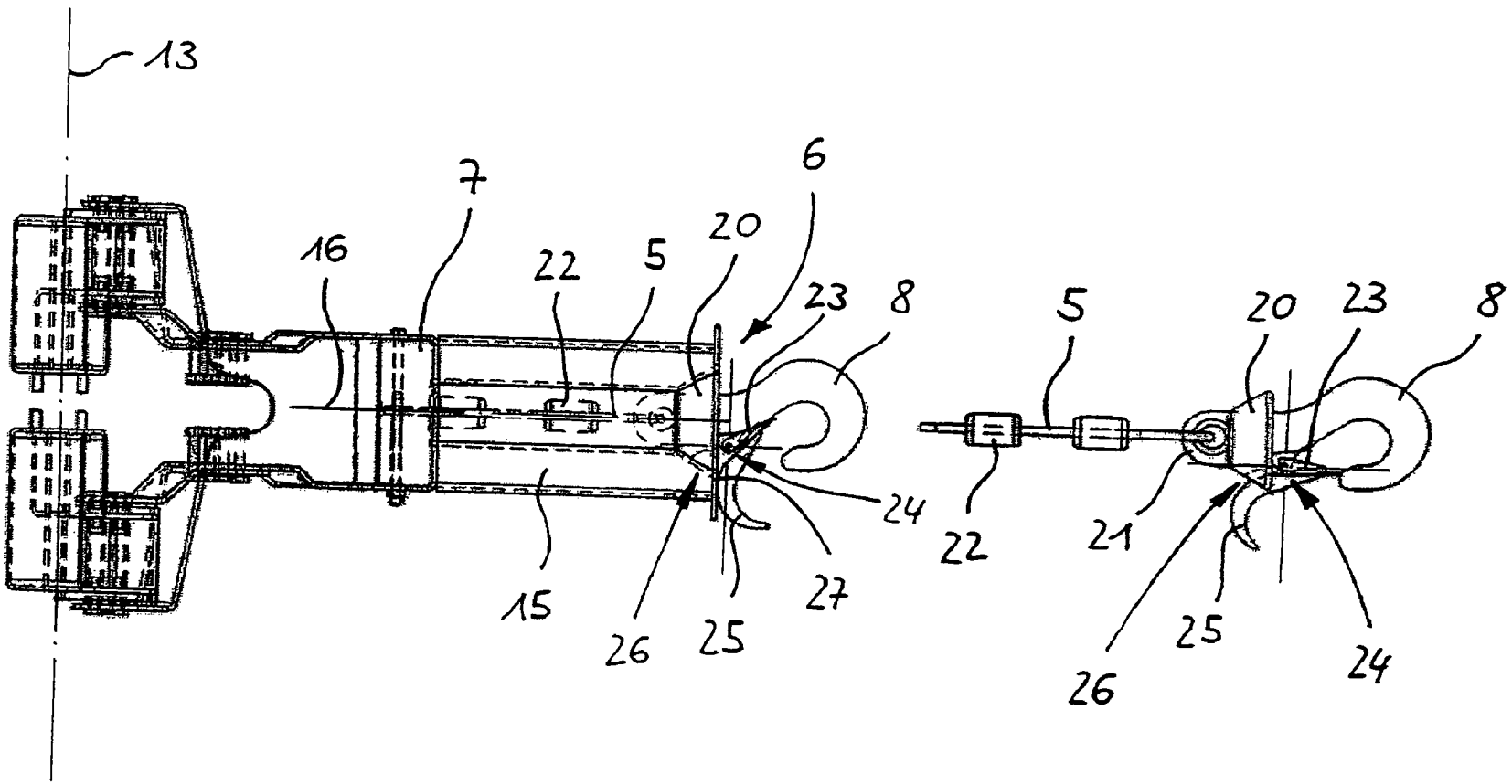
Figures 5, 6:
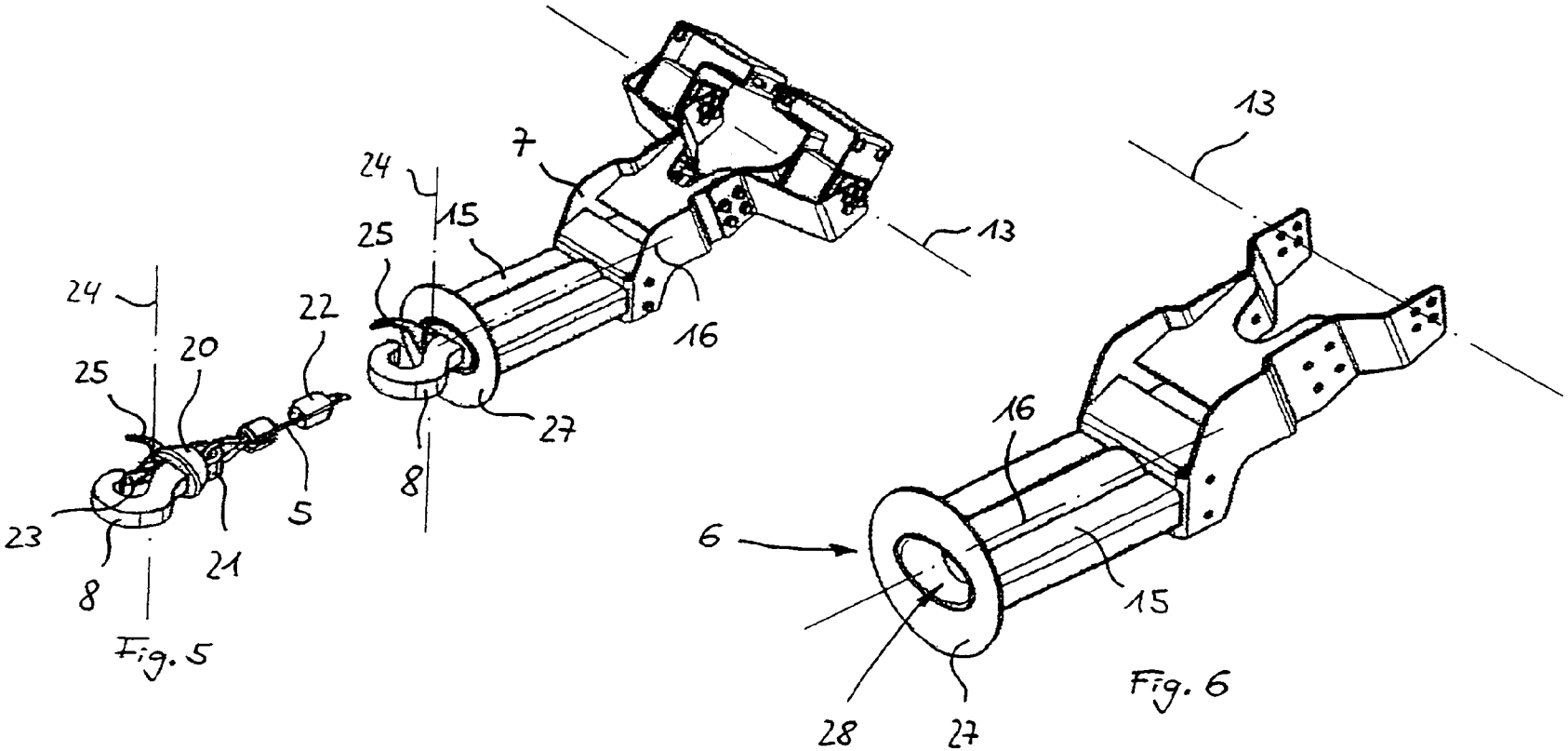

Further advantages and features of the invention can be gathered from the claims and from the following description of a preferred exemplary embodiment which is illustrated on the basis of the figures, in which:

FIG. 1 shows, in a schematic illustration, a front view of a tracked vehicle having a winch arm of a rope winch, and also an anchor part with a rope loop and a holding shackle, FIG. 2 shows, in a perspective illustration, the winch arm of the rope winch as per that of FIG. 1, FIG. 3 shows an enlarged detail of the winch arm as per FIG. 2, FIG. 4 shows a plan view of a guide part of the winch arm as per FIGS. 2 and 3, FIG. 5 is a perspective illustration of the guide part as per FIG. 4, FIG. 6 is a perspective illustration of a modular unit of the guide part as per FIG. 5.

A piste maintenance vehicle, which is embodied as a tracked vehicle 1, is used for the preparation of ski runs. The tracked vehicle 1 has, in a fundamentally known way, a functional platform behind a driver's cab, on which functional platform in the illustrated exemplary embodiment a rope winch 2 is mounted. The rope winch 2 is provided with a winch arm 3 which, as per the illustration of FIG. 1, projects laterally from the tracked vehicle 1, in which winch arm 3 is guided a winch rope 5 which projects out to a front end side 6 of the winch arm 3. The winch arm 3 is driven so as to rotate or pivot about a vehicle vertical axis 4 and can be pivoted about a tilting axis 19, which is illustrated in FIG. 2, by means of a hydraulic cylinder 18. Provided in the winch arm 3 are rope guide devices (not illustrated in any more detail) which guide the winch rope 5 from the end side 6 of the winch arm 3 along the angled shape of the winching arm 5 to a rope drum (not illustrated) on which the winch rope 5 is held such that it can be wound and unwound. While the winch arm 3 is, in a known way, designed in a section close to the vehicle as a positive guide means for the winch rope 5, a guide part 7, which is illustrated in more detail in particular in FIGS. 3 to 6, is mounted in an end region remote from the vehicle, which guide part 7, operatively connected to an anchoring device designed as a hook 8, allows the remote-controllable and preferably partially automated coupling and/or uncoupling operation according to the invention of the winch rope 5 to and/or from the anchor part 9.

A pole 9 which is embodied as a positionally fixed anchor part is provided for fixing the hook 8 which is attached to the end side of the winch rope 5, which pole 9 is equipped by way of example with both a rope loop 10, which is placed around the pole 9, and a holding shackle 11. A pole 9 of said type is typically mounted above a ski slope which is to be prepared using the tracked vehicle 1, and allows a transmission of tractive force from the rope winch 2 of the tracked vehicle 1 to an underlying surface. As a result, a considerable part of the drive power of the tracked vehicle 1 can be transmitted via the winch rope 5, and need not be transmitted via the crawlers 12 into the underlying surface which is to be prepared. As a result, the loading of the underlying surface by the tracked vehicle 1 can be reduced, and the quality of piste preparation can be improved.

In order to allow a remote-controlled coupling and uncoupling of the winch rope 5 to and from the rope loop 10 or the holding shackle 11, which is to be carried out in particular from the driver's cab of the tracked vehicle, the guide part 7 according to the invention is mounted on an end region, facing away from the tracked vehicle 1, of the winch arm 3. The guide part 7 is mounted on the winch arm 3 so as to be rotatable about a pivot axis 13 which is oriented in the horizontal direction, with the pivot axis 13 being arranged coaxially with respect to a rotational axis of a guide roller 14. The guide part 7 is shown in FIGS. 1 to 3 in a lower pivoting position which is determined by a pivot stop (not illustrated). It is possible for the guide part 7 to pivot clockwise upward as per FIG. 1 in order to ensure self-adjusting angular adaptation of the guide part 7 and of the winch rope 5 which is guided therein to different operating states of the tracked vehicle 1 when the winch rope 5 is used. The guide part 7, which is constructed from a plurality of components, has an angled configuration in the side view of FIG. 1, with a central axis 16 of a profiled tube 15 of the guide part 7 intersecting the guide roller 14 at least approximately tangentially in order to ensure that the winch rope 5 is fed into the profiled tube 15 and to the guide roller 14 in an advantageous manner. Two limiting rollers 17, which are oriented parallel to one another, are provided between the guide roller 14 and the profiled tube 15, which limiting rollers 17 each laterally guide the winch rope 5.

The profiled tube 15 has an essentially circular cross section and is reinforced by laterally-mounted box profiles. In an end-side aperture region 28, the profiled tube is widened in the manner of a funnel in the form of an oval cone, as can be seen in particular from FIG. 6. The hook 8 is provided at the end side with a correspondingly shaped oval-cone-like, funnel-shaped guide face 20 which merges into a fastening lug 21. The oval-cone-shaped surfaces, which are coordinated with one another, of the aperture region 28 and of the guide face 20 of the hook 8 make it possible to ensure an essentially horizontal orientation, illustrated in FIGS. 3, 4 and 5 and predefined by positive locking, of the hook 8 relative to the guide part 7, which facilitates coupling or uncoupling of the hook 8 to or from the anchor part 9.

The free end of the winch rope 5 is guided through the fastening lug 21, is folded round semicircularly and is fastened at the end region of the winch rope 5 by means of two holding clamps 22. In this way, the hook 8 can move approximately completely freely relative to the end region of the winch rope 5, so that an introduction of bonding forces into the winch rope 5 can be almost completely avoided.

The hook 8 is assigned a pivoting lever 23 which is preloaded by means of a return spring (not illustrated) in the closing direction of the hook 8 and which can be pivoted about a pivot axis 24 between a locking position illustrated at the right-hand side in FIG. 4 and an opening position illustrated at the left-hand side of FIG. 4. In order to be able to carry out said pivoting movement without the direct manual engagement of a user, an actuating means embodied as a sickle-shaped opening 25 is assigned to the pivoting lever 23. The opener 25 is welded onto the pivoting lever 23 and, in the locked position of the pivoting lever 23, projects into a slot 26 which is provided in the guide face 20 of the hook 8. It is ensured in this way that the opener 25 impinges on an end face, which is provided as a deflection face 27, of the profiled tube 15, and initiates an opening movement of the pivoting lever 23, already as the hook 8 approaches. After the guide face 20 has been fully received in the oval-cone-shaped aperture 28 of the profiled tube 15, the opener 25 causes the hook 8 to fully open. During the opening movement; the sickle-shaped opener 25 slides with a pivoting movement on the deflection face 27 and loads the return spring (not illustrated) of the pivoting lever 23. In the opening position of the pivoting lever 23, the sickle-shaped opener 25 additionally forms an insertion aid which facilitates the coupling of the hook 8 to the rope loop 10 or the holding shackle 11.

The approach of the hook 8 to the deflection face 27, and the resulting opening movement of the pivoting lever 23, is brought about in a simple way by exerting a tractive force by means of the drive device. In order to lock the hook 8 by means of a pivoting movement of the pivoting lever 23 into the locking position, the tractive force exerted by the drive device is reduced, or a tractive force pointing away from the winch arm 3 is exerted on the hook 8, so that the hook 8 is removed from the deflection face 27 and the positive locking of the opener 25 with the deflection face 27 is removed. As a result of the deformation energy stored in the return spring, the opener 25 slides on the deflection face 27 in the direction of the locking position until the pivoting lever 23 assumes the locking position shown in the left-hand illustration of FIG. 4.

The embodiment of the invention illustrated in FIGS. 1 to 6 is distinguished by a simple configuration in which the winch rope 5, the hook 8, the winch arm 3 and the guide part 7 are free from active actuating devices. Instead, the movement of the pivoting lever 23 between the opening position and the locking position is provided solely as a result of the opener 25 which is provided on the hook 8 approaching or moving away from the deflection face 27 provided on the guide part 7.

For a remote-controlled coupling of the hook 8 to a rope loop 10 or a holding shackle 11, the hook 8 is firstly moved closer to the deflection face 27 of the guide part 7 by exerting a tractive force on the winch rope 5 by means of the drive device. The sickle-shaped opener 25 then slides on the deflection face 27 and leads to an opening movement of the pivoting lever 23. As a result of the oval-cone-shaped, funnel-shaped configuration of the aperture 28 and of the guide face 20 of the hook 8, the hook 8 is positively oriented into an essentially horizontal position in which the hook 8 can advantageously be hooked to the rope loop 10 or to the holding shackle 11 solely by pivoting the rope winch 2 about the vehicle vertical axis 4. Here, the sickle-shaped opener 25 serves as an insertion aid between the hook 8 and the rope loop 10 or holding shackle 11. The tracked vehicle 1 can subsequently be removed from the pole 9. The positively locking connection between the opener 25 and the deflecting face 27 is therefore automatically and positively removed as a result of the minimum distance between the hook 8 and the deflecting face 27 being exceeded, and the pivoting lever 23 is moved into the locking position by the return force of the return spring, so that the winch rope 5 is securely anchored on the pole 9 and tractive force can be transmitted from the tracked vehicle 1 into the pole 9. The hook 8 is decoupled from the pole in a similar way.

The invention claimed is:

1. Winch for a vehicle, with an elongate flexible traction means which is assigned to a drive device which is configured for the introduction of tractive forces to the traction means, and with a guide device which is provided for feeding the traction means to the drive device, and also with an anchoring device which is mounted on a free end region, facing away from the drive device, of the traction means and is configured so as to be adjustable between an opening position and a locking position, in order to allow a positive anchoring of the traction means on a positionally fixed anchor part, wherein the anchoring device and/or the guide device are/is assigned an actuating means which is configured for an opening and/or closing movement of the anchoring device, and wherein the actuating means is configured in such a way that, when a minimum distance between the anchoring device and guide device is undershot, a positive movement of the anchoring device into the opening position is provided.

2. Winch for a vehicle, with an elongate flexible traction means which is assigned to a drive device which is configured for the introduction of tractive forces to the traction means, and with a guide device which is provided for feeding the traction means to the drive device, and also with an anchoring device which is mounted on a free end region, facing away from the drive device, of the traction means and is configured so as to be adjustable between an opening position and a locking position, in order to allow a positive anchoring of the traction means on a positionally fixed anchor part, wherein the anchoring device and/or the guide device are/is assigned an actuating means which is configured for an opening and/or closing movement of the anchoring device, and wherein the actuating means is configured in such a way that, when a minimum distance between the anchoring device and the guide device is exceeded, a positive movement of the anchoring device into the locking position is provided.

3. Winch for a vehicle, with an elongate flexible traction means which is assigned to a drive device which is configured for the introduction of tractive forces to the traction means, and with a guide device which is provided for feeding the traction means to the drive device, and also with an anchoring device which is mounted on a free end region, facing away from the drive device, of the traction means and is configured so as to be adjustable between an opening position and a locking position, in order to allow a positive anchoring of the traction means on a positionally fixed anchor part, wherein the anchoring device and/or the guide device are/is assigned an actuating means which is configured for an opening and/or closing movement of the anchoring device, and wherein the guide device is coordinated, in an aperture region for the traction means, with an outer contour of the anchoring device, so that, when the minimum distance between the anchoring device and the guide device is undershot, a positive actuation of the actuating means is ensured.

4. Winch for a vehicle, with an elongate flexible traction means which is assigned to a drive device which is configured for the introduction of tractive forces to the traction means, and with a guide device which is provided for feeding the traction means to the drive device, and also with an anchoring device which is mounted on a free end region, facing away from the drive device, of the traction means and is configured so as to be adjustable between an opening position and a locking position, in order to allow a positive anchoring of the traction means on a positionally fixed anchor part, wherein the anchoring device and/or the guide device are/is assigned an actuating means which is configured for an opening and/or closing movement of the anchoring device, and wherein the guide device is coordinated, in an aperture region for the traction means, with an outer contour of the anchoring device, so that, when the minimum distance between the anchoring device and the guide device is undershot, a positive guidance for the anchoring device is ensured.

5. Winch for a vehicle, with an elongate flexible traction means which is assigned to a drive device which is configured for the introduction of tractive forces to the traction means, and with a guide device which is provided for feeding the traction means to the drive device, and also with an anchoring device which is mounted on a free end region, facing away from the drive device, of the traction means and is configured so as to be adjustable between an opening position and a locking position, in order to allow a positive anchoring of the traction means on a positionally fixed anchor part, wherein the anchoring device and/or the guide device are/is assigned an actuating means which is configured for an opening and/or closing movement of the anchoring device;

wherein the anchoring device is of hook-shaped design and is provided with a pivoting lever for closing the hook, with the actuating means being configured for an activation of the pivoting lever;

wherein the actuating means is attached to the pivoting lever;

wherein the pivoting lever and the actuating means are mounted in the manner of a rocker on the anchoring device; and wherein the guide device has a deflection surface for the actuating means in an aperture region for the traction means, said deflection surface being provided for a positive control of the actuating means when a minimum distance between the anchoring device and guide device is undershot.

6. Winch according to claim 5, wherein the actuating means is configured, at least in sections, in the shape of a sickle for a sliding movement on the deflection surface of the guide device and for feeding the traction means into the anchoring device.

7. Winch according to claim 6, wherein the anchoring device is mounted so as to be freely movable on a traction means lug provided on the end side on the free end of the traction means.

8. Winch for a vehicle, with an elongate flexible traction means which is assigned to a drive device which is configured for the introduction of tractive forces to the traction means, and with a guide device which is provided for feeding the traction means to the drive device, and also with an anchoring device which is mounted on a free end region, facing away from the drive device, of the traction means and is configured so as to be adjustable between an opening position and a locking position, in order to allow a positive anchoring of the traction means on a positionally fixed anchor part, characterized in that the anchoring device and/or the guide device are/is assigned an actuating means which is configured for an opening and/or closing movement of the anchoring device, wherein the guide device is assigned sensor means which are configured for detecting and indicating the opening position and/or the locking position of the anchoring device.

* * * * *